United States Patent [19]

Apperson et al.

[11] Patent Number: 4,991,267

[45] Date of Patent: Feb. 12, 1991

[54] CLAMP FOR FLEXIBLE BAG

[75] Inventors: Curtis R. Apperson, Green Oaks, Ill.; Richard Finger, Metairie, La.; Robert A. Weisenbach, Libertyville, Ill.

[73] Assignee: Abbott Laboratories, Abbott Park, Ill.

[21] Appl. No.: 521,216

[22] Filed: May 8, 1990

[51] Int. Cl.[5] ..... B65D 77/10

[52] U.S. Cl. ..... 24/30.5 R; 24/516

[58] Field of Search ..... 24/30.5 R, 495, 496, 24/489, 515–520; 383/68, 63, 78, 81

[56] References Cited

U.S. PATENT DOCUMENTS

| | | | |
|---|---|---|---|
| 567,537 | 9/1896 | Ernst | 24/516 |
| 1,387,975 | 8/1921 | Goddard | 383/68 X |
| 1,688,042 | 10/1928 | Gaess | 24/517 X |
| 3,036,506 | 5/1962 | Andresen, Jr. | 24/30.5 R X |
| 4,648,160 | 3/1987 | Spinosa et al. | 24/30.5 R X |

FOREIGN PATENT DOCUMENTS

| | | | |
|---|---|---|---|
| 1475241 | 4/1969 | Fed. Rep. of Germany | 24/518 |

*Primary Examiner*—James R. Brittain

*Attorney, Agent, or Firm*—A. Nicholas Trausch

[57] ABSTRACT

A clamp for dividing a flexible bag includes three pivotally joined members. A sealing member has a sealing surface such as an extended bead. A center member has a first face having an undercut groove forming a pair of arms to engage the sealing surface and the flexible bag. A second face has a locking groove. A locking member has a wedge portion engageable in the locking groove so as to deflect the arms around the sealing surface.

7 Claims, 4 Drawing Sheets

CLAMP FOR FLEXIBLE BAG

FIELD OF THE INVENTION

This invention is related generally to a clamp for dividing a flexible bag, and more particularly, a pivoting, pinch-type clamping mechanism for sealingly dividing a flexible medicant bag into two separate chambers.

BACKGROUND OF THE INVENTION

Medicaments, or drugs, administered in many I.V. treatments are normally flowable substances packaged in vials whose interior is maintained in a sterile condition. If the medicament or drug is of such a strength or potency that it must be administered with a diluent, it is often administered using the Abbott ADD-Vantage® drug delivery system as shown, for example, by U.S. Pat. 4,614,515.

The above disclosed ADD-Vantage system and other closed bag I.V. systems function well when the fluid is administered via gravity flow through an I.V. set. The I.V. bag must be located higher than the point of administration into the patient and the fluid merely flows out of the bottom of the bag which has been accessed by a piercing pin.

However, in certain situations, when the infusion is to be induced by pressurized flow control means other than gravity, the bag and fluid may be lower than the point of infusion into the patient. In these situations there is concern that excessive air may be infused into the patient or that all of the drug may not be administered. Thus it is desireable to have a clamping mechanism which can isolate the medicament in a portion of the bag which is in fluid communication with the outlet port.

In summary, in a few special circumstances, it is desirable to provide a clamping mechanism to insure proper and efficient infusion of I.V. solutions from flexible bags.

OBJECTS OF THE INVENTION

It is an object of this invention to provide a clamp for sealingly dividing a flexible bag.

It is another object of this invention to provide a clamping mechanism such that the entire liquid contents of a medicament bag can be infused.

Another object of this invention is to provide a clamp that can be easily manipulated and securely locked by patients undergoing I.V. administration.

These and other important objects will be apparent from the description of this invention which follows.

SUMMARY OF THE INVENTION

This invention is an improved clamp for sealingly dividing a flexible bag such as a medicament bag for I.V. administration.

This invention includes three clamp components including (1) a sealing member having a longitudinal sealing surface, (2) a center member having a first face having a pair of longitudinally extending arms formed by a longitudinally undercut channel, such that the channel matingly engages with the sealing surface and the flexible bag to be divided, and a second opposite face on the center member having a longitudinal groove, and (3) a locking member having a longitudinal wedge engageable in the groove so as to inwardly deflect the arms so as to lock around the engaged sealing surface and flexible bag. The three clamp members are pivotally joined preferably at a common end by a single pivot pin but alternatively may be joined by two pivot pins at the same end or at opposite ends.

In the preferred embodiment, the sealing surface is an extended bead extending from a longitudinal flange on the sealing member. The undercut channel of the center member has an omega-shaped cross section. The groove on the opposite face of the center member has a tapering cross section such as a v-shaped cross section. The wedge on the locking member has only one inclined plane such that one face of the wedge is in frictional engagement with the sidewalls of the groove when the locking member is engaged with the center member.

BRIEF DESCRIPTION OF THE DRAWINGS

FIGS. 1 and 2 best illustrate the three major component members of the preferred embodiment of this invention. As best seen in FIG. 1, all three members are preferably longitudinally extending members of sufficient length to traverse the bag to be sealingly divided. The clamp 10 is comprised of a sealing member 12, a center member 14, a locking member 16, and at least one pivot pin 18. The three clamp members are preferably material such as a moldable plastic while the pivot pin may be a metal rivet or a plastic pin.

Figure 2:
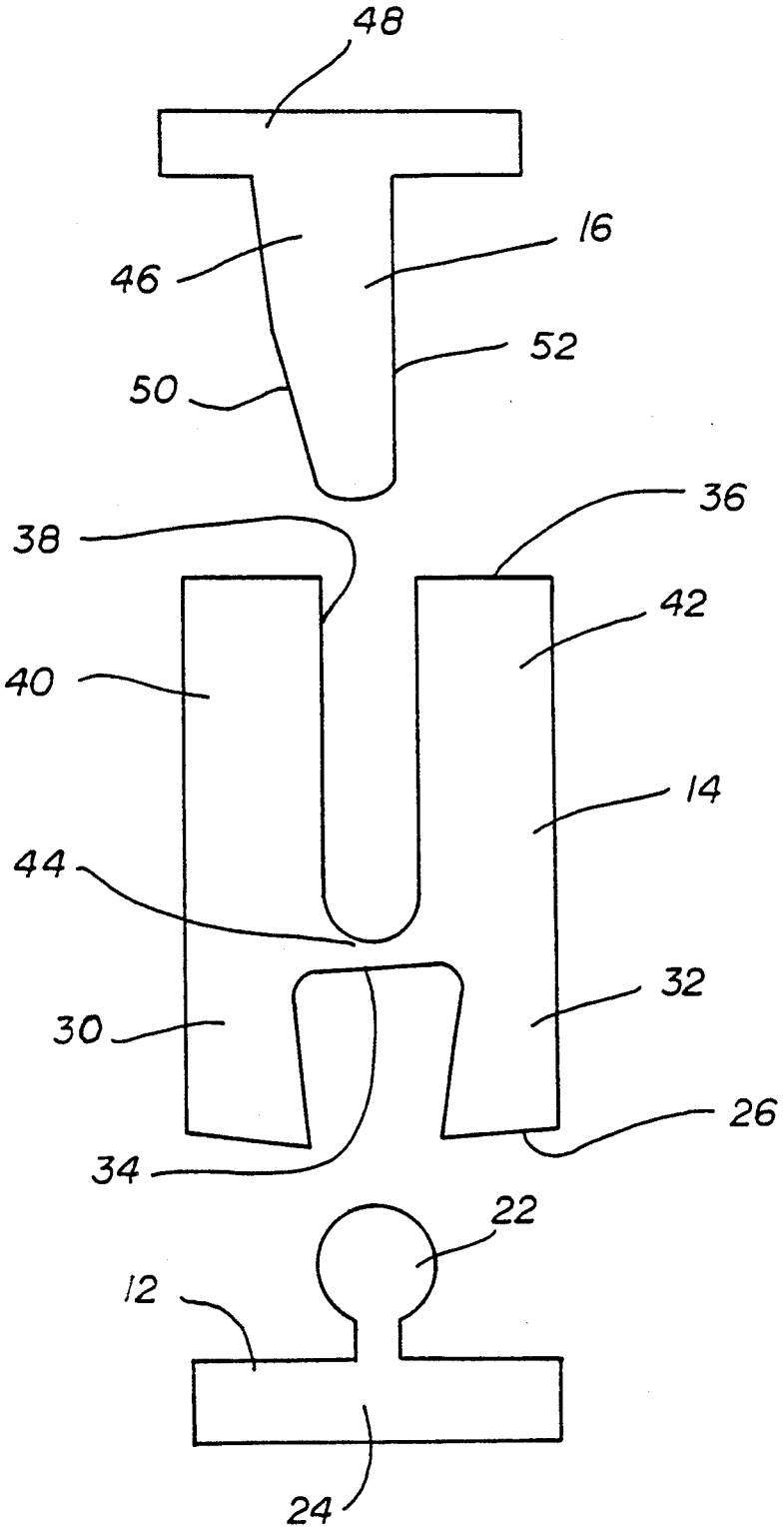
FIG. 2 is a cross sectional view of the three clamp members along line 2'2 of FIG. 1.

As best seen in FIG. 2, the sealing member 12 has a sealing surface 22 that extendes outwardly from a longitudinal bar portion 24. The preferred embodiment of the sealing surface 22 is a extended bead but other cross sectional configurations that can be captured within the arms are also suitable and are within the scope of this disclosure.

The center member 14 is preferably a longitudinally bar member having a substantially rectangular cross section as best seen in FIG. 2. The center member 14 has a first face 26 having a pair of longitudinally extending arms 30 and 32 which are formed by a longitudinally extending undercut channel 34. Preferably the undercut channel has an omega-shaped cross section although other undercut configurations are also within the scope of this disclosure. In any case, the dimensions of the channel are such that the channel can matingly engage with sealing surface 22. Additional clearance is allowed between the sealing surface 22 and the narrowest dimension of the channel 34 so that the double ply film thickness of a bag can be squeezed into the channel without undue pressure.

The center member 14 also includes a second opposite face 36 having a longitudinal groove 38. The groove can be straight walled or tapered or can be a v-shape, whichever allows easiest manufacture. The groove depth is substantially greater than the channel depth such that there is mechanical advantage, that is the arms 40 and 42 formed by the groove can be moved to produce an opposite movement of the channel arms 30 and 32. Inward pivotal movement of arms 30 and 32 is produced by dimensioning the thickness (i.e., distance between channel 34 and groove 38) of bridge portion 44 to be consistent with the clamp material so as to allow outward pivoting of arms 40 and 42 rather than elastic stretching of bridge 44.

The locking member 16 has a wedge portion 46 extending outward from a flange portion 48. The wedge portion 46 preferably has only one inclined plane surface as shown for example at 50 whereas the other surface 52 is substantially parallel to the groove surfaces 38. The inclined surfaces 50 will deflect at least one arm 40 or 42 outward when the locking member is inserted into the center member 14. The flat faced member 52 will have increased frictional resistance with the groove 38 and will resist the locking member from slipping out of the center member thus locking the clamp.

Figure 3:
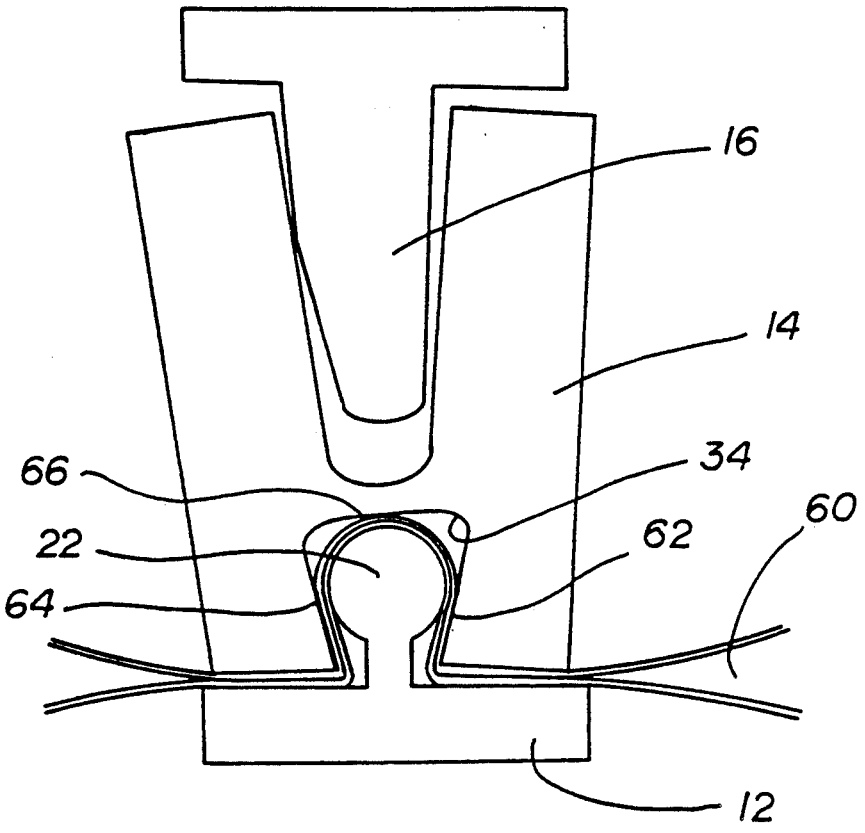
FIG. 3 is a cross sectional view similar to FIG. 2 of the clamp, but in a closed and locked position so as to divide a medicament bag.
Figure 4:
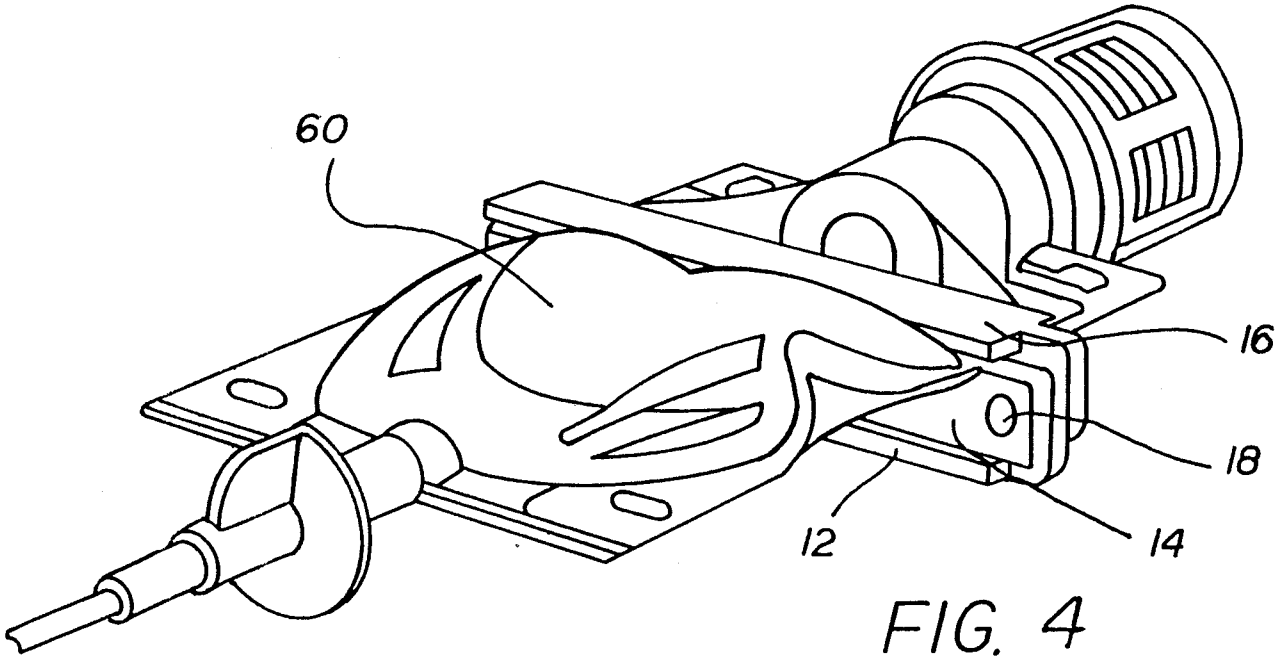
FIG. 4 is a perspective view of a clamp dividing a medicament bag which has an additive vial.

As shown in FIG. 3, a bag 60 having two film thicknesses has been secured and sealingly divided by the sealing surface 22 and the undercut channel 34. The locking member 16 has been inserted into the groove causing the groove arms to deflect outward thus causing the channel arms to deflect inward and pinch the bag to the sealing surface. The bag is sealed at two primary points 62 and 64 and also at a secondary seal point 66. A perspective view of a clamped bag is shown in FIG. 4.

Figure 1:
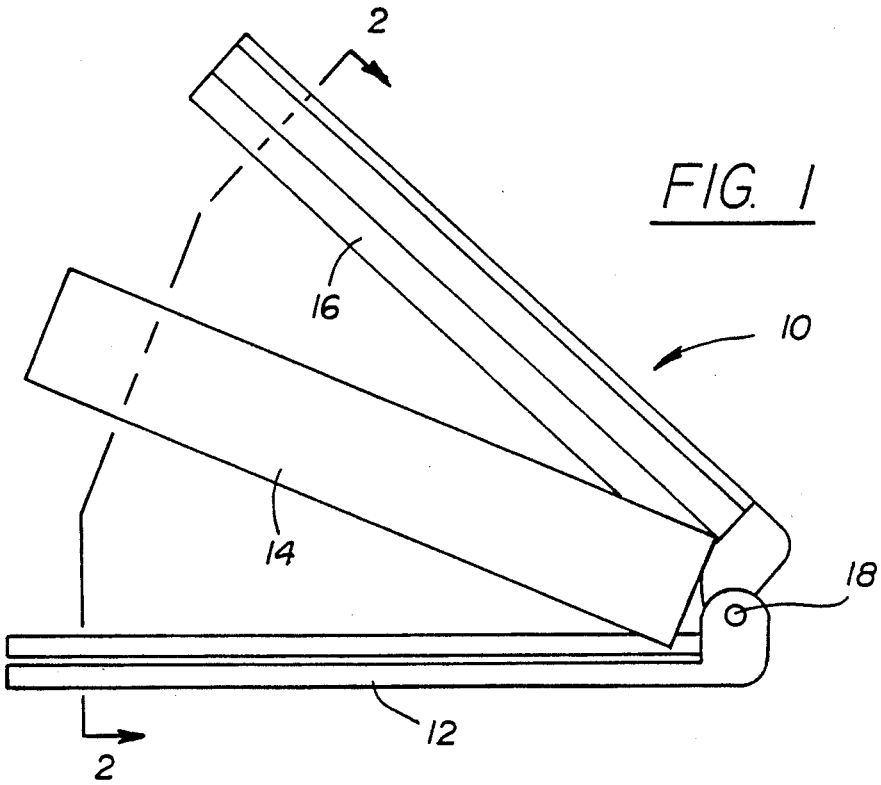
FIG 1 is a side view of the clamp according to the invention in an open and unlocked position.
Figure 5:
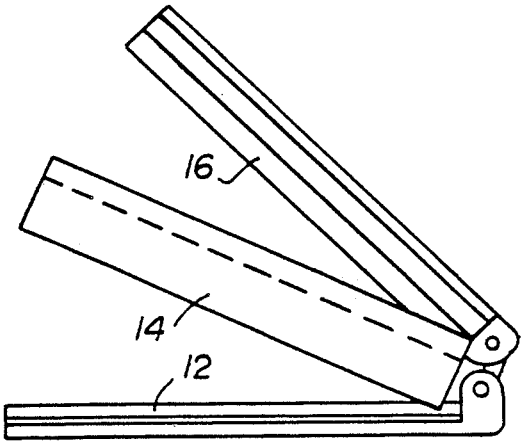
FIGS. 5 and 6 are alternative embodiments.
Figure 6:
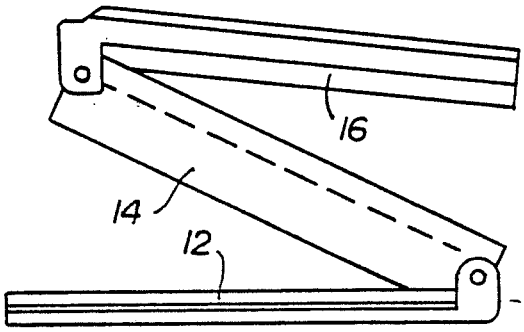

As seen in FIG. 1, pivot pin 18 pivotally joins the sealing member 12, the center member 14 and the locking member 16 at a common end in the preferred embodiment. In a first alternative embodiment, two pins could join two different members at opposite ends (i.e., 12 to 14 at one end, 14 to 16 at the distal end). In a second alternative embodiment, two pins could join two different members (i.e., 12 to 14 and 14 to 16) at the same end.

It is understood that the above descriptions are made only by way of example and are not intended to limit the scope of the invention.

We claim:

1. A clamp for sealingly dividing a flexible bag, said clamp comprising:

a sealing member having a longitudinal sealing surface;

a center member having a first face having a pair of longitudinally extending arms formed by a longitudinally extending undercut channel, said channel matingly engageable with said sealing surface and said flexible bag, and a second opposite face having a longitudinal groove;

a locking member having a longitudinal wedge engageable in said groove so as to inwardly deflect said arms so as to lock around said engaged sealing surface and flexible bag;

and means for pivotably joining said sealing member, said center member and said locking member.

2. The clamp of claim 1 wherein said means for pivotably joining is a single pivot pin pivotably forming a common end of said sealing member, said center member and said locking member.

3. The clamp of claim 1 wherein said means for pivotably joining is a first pivot pin pivotably joining said sealing member and said center member and a second pivot pin pivotably joining said center member and said locking member.

4. The clamp of claim 1 wherein said sealing surface is an extended bead.

5. The clamp of claim 4 wherein said undercut channel has an omega-shaped cross section.

6. The clamp of claim 1 wherein said groove has a V-shaped cross section.

7. The clamp of claim 6 wherein only one face of said wedge has an inclined plane.

* * * * *